US005211162A

United States Patent [19]

Gillen, Jr. et al.

[11] Patent Number: 5,211,162

[45] Date of Patent: May 18, 1993

[54] APPARATUS AND METHOD FOR MASSAGING THE BACK UTILIZING PNEUMATIC CUSHIONS

[75] Inventors: John F. Gillen, Jr.; Andrew J. Martin, both of Bethlehem, Pa.

[73] Assignee: Pneu-Mobility, Inc., Bethlehem, Pa.

[21] Appl. No.: 727,666

[22] Filed: Jul. 9, 1991

[51] Int. Cl.[5] ..... A61H 7/00

[52] U.S. Cl. ..... 128/64; 128/24 R; 128/33

[58] Field of Search ..... 128/24.2, 24 R, 25, 128/33, 54, 55, 64

[56] References Cited

U.S. PATENT DOCUMENTS

| | | | |
|---|---|---|---|
| 2,361,242 | 10/1944 | Rosett | 128/33 |
| 3,678,520 | 7/1972 | Evans | 128/24 R |
| 3,760,801 | 9/1973 | Borgeas | 128/33 |
| 3,826,249 | 7/1974 | Lee et al. | 128/24 R |
| 4,013,069 | 3/1977 | Hasty | 128/24 R |
| 4,231,355 | 11/1980 | Hara | 128/24.2 |
| 4,396,010 | 8/1983 | Arkans | 128/24 R |
| 4,408,599 | 11/1983 | Mummert | 128/24 R |
| 4,551,874 | 11/1985 | Matsumura | 5/453 |
| 4,583,255 | 4/1986 | Mogaki | 128/33 |
| 4,688,556 | 8/1987 | Keller, Jr. | 128/57 |
| 4,762,121 | 8/1988 | Shienfeld | 128/64 |
| 4,793,328 | 12/1988 | Kolstedt | 128/24 R |
| 4,865,020 | 9/1989 | Bullard | 128/64 |
| 4,986,260 | 1/1991 | Iams | 128/24 R |

OTHER PUBLICATIONS

Hammacher Schlemmer Late Spring '91 Catalog—Stress Soothing All Body Massager (p. 18); Orthopedic Seat Back (p. 19); The Shiatsu Massaging Lounger (p. 20); and the Personal Shiatsu Massager (p. 21).

The Sharper Image Catalog, Jul. through Aug. 1991—Get-A-Way Chair (p. 8) and The Shiatsu Massager (p. 54).

*Primary Examiner*—Robert A. Hafer

*Assistant Examiner*—David J. Kenealy

*Attorney, Agent, or Firm*—Joseph J. O'Keefe; Charles A. Wilkinson

[57] ABSTRACT

The apparatus comprises a pad and a sequential pressure device that includes a pneumatic system and a control system. The pad comprises a plurality of adjacent chambers extending transverse to the pad's longitudinal centerline and has a lower section with at least two chambers and an upper section with at least three chambers. Two adjacent chambers of the lower section have approximately the same transverse cross-sectional area for about their lengths. Each chamber of the upper section includes a right portion, a left portion and an intermediate portion which has a narrowed center portion of reduced cross-sectional area connecting with the right and left portions. Inflation of an upper section chamber causes expansion of the right, left and intermediate portions thereof with a void created about the narrowed intermediate portion. The method makes use of the apparatus to massage the back of a patient placed in a supine position on the pad to mobilize the spine and stretch and relax the musculature and soft tissue of the back while avoiding placement of undue pressure on the thoracic vertebrae portions of the spine which are positioned above the intermediate portions of the chambers of the pad upper section.

26 Claims, 7 Drawing Sheets

H'-1
L'-1
41
42
53A
50
g
f
H-4
B'-1
B'
D
Dd
51Z
A'-1
A'
51A
2
1
10
9
39
14A
35
31
19A
12A
20
19
11
12
40

FIG. 5
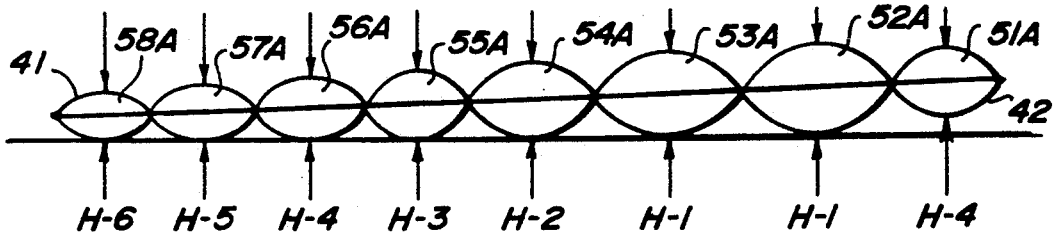
FIG. 6
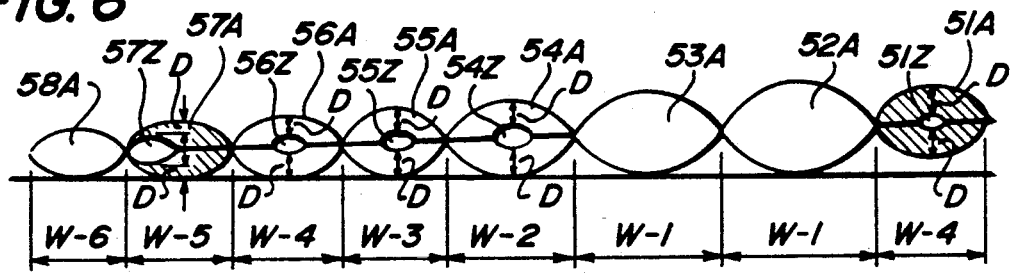
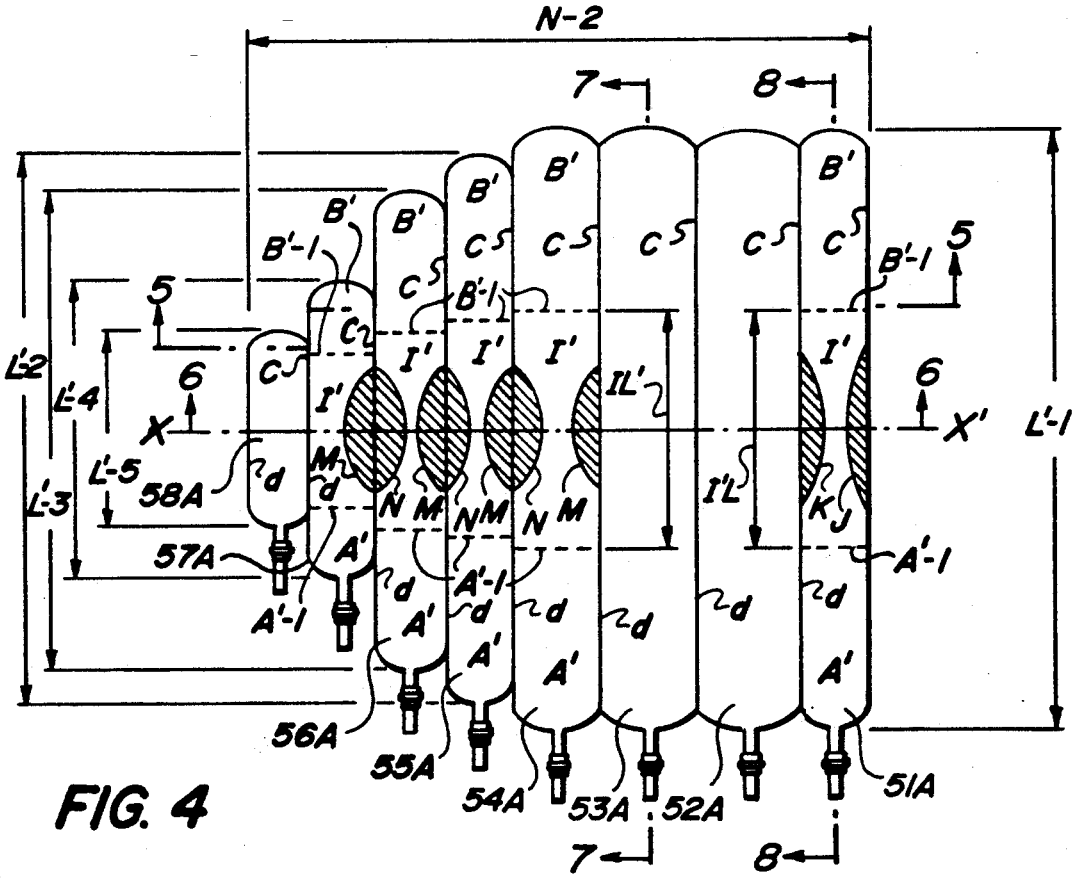
FIG. 4

APPARATUS AND METHOD FOR MASSAGING THE BACK UTILIZING PNEUMATIC CUSHIONS

BACKGROUND OF THE INVENTION

This invention is directed to therapy apparatus and a method for massaging a patient's back. More particularly, the apparatus and method relate to the massaging of portions of a patient's back in a sequential manner by a pad having a plurality of adjacent inflatable and deflatable chambers to mobilize the spine and massage, stretch, and relax the musculature and soft tissue. This allows the spine to realign, thereby decreasing pain and increasing mobility and range of motion.

Discomfort, pain, injuries and diseases involving the back are common. The back consists of a column of bones called vertebrae, which are separated by discs that act as cushions and are held together by muscles and ligaments. A normal healthy back has three natural curves, the upper cervical curve, the thoracic curve and the lower lumbar curve. When these three curves are in normal alignment, a person's body weight is evenly distributed throughout the vertebrae and discs, and when the muscle groups of the back are strong and flexible the person may move freely and without effort. Natural aging, premature aging, misuse, or injury, give rise to certain spinal problems which cause a variety of symptoms, such as stiffness, pain, tingling and numbness. More serious back problems may require corrective surgery, but the majority of back problems respond favorably to non-surgical therapy. Many back problems may be healed by a combination of rest, modalities, medication, or bracing.

Many types of apparatus and methods have heretofore been proposed and developed for alleviating back and limb problems by massaging the back or one or more parts of a patient's body by means of inflatable and deflatable cells.

U.S. Pat. No. 4,231,355 to Katsumasa Hara discloses an air device for massaging a body or body portion by means of a pad on a mat which holds the whole body or by means of a shaped article wrapped about a body portion. The pad/mat and the shaped articles are formed with a plurality of adjacent air inflatable bags which may be provided with their own inlet and exhaust ports for compressed air.

U.S. Pat. No. 4,688,556 to Moreau A. Keller, Jr. is directed to a spinal massage and exercise device comprising one or more yielding oblate spheroids rotatably held in a support frame. The user of the device places his or her spine on the spheroids and propels the device with his or her legs to move the device and massage the spine.

The prevalency of apparatus for dealing with back problems is illustrated in the Late Spring (1991) mail-order catalog of Hammacher Schlemmer of Fairfield, Ohio, which offers a number of devices for dealing with back problems. On page 18 is shown a Stress Soothing All Body Massage Pad that creates a continuous series of finger-like massage pulses across a body and includes a lumbar support system. On page 19 is shown an Orthopedic Back Rest including a lumbar back support. On page 20 is shown a Massaging Lounger which is electronically operated to provide a smooth rolling massage to soothe sore muscles. On page 21 is shown a Personal Massager comprising two small round nodules which roll in a circular motion and which may be positioned to massage tired aching muscles in the user's neck, back, legs, or arms.

U.S. Pat. No. 3,826,249 to Arthur L. Lee, et al.; U.S. Pat. No. 4,013,069 to James H. Hasty; U.S. Pat. No. 4,396,010 to Edward J. Arkans; U.S. Pat. No. 4,480,599 to Thomas A. Mummert; U.S. Pat. No. 4,762,121 to Izhar Shienfeld; U.S. Pat. No. 4,793,328 to Mark Kolstedt; and U.S. Pat. No. 4,865,020 to Horace Bullard are directed to apparatus and/or a method for the sequential application of pressure to a portion of the body.

While the developments described in each of the above patents or catalog may operate in a therapeutic manner to deal in a reasonable manner with certain back and limb problems, none have the same design or structure or operate in as effective a manner to deal with certain back problems as does the apparatus and method of this invention.

SUMMARY OF THE INVENTION

In accordance with this invention, the therapy apparatus comprises a pad, which includes a plurality of adjacent inflatable chambers connected to a sequential pressure device that includes a pneumatic system and a control system. The pad chambers extend transverse to the pad length and each is connected to the pneumatic system. The control system regulates the flow of compressed air from the pneumatic system to the pad chambers in a manner to sequentially inflate one or more chambers of the pad in a cyclical wave motion from pad bottom to top. The pad has a length to extend from bottom to top through the lumbar, thoracic and cervical portions of the spine of a patient. The lengths of the pad chambers extend transverse to the length of the pad. Two adjacent chambers in the lower section of the pad have approximately the same transverse cross sectional area for about their lengths. When inflated these two chambers assume a flattened cylindrical form for their lengths. In the upper section of the pad are a plurality of adjacent chambers, several of which have a right portion, a left portion, and a narrowed intermediate portion. The right and left portions of each such chamber have about the same transverse cross-sectional area and each intermediate portion narrows from the right and left portions toward the chamber's center to form an intermediate portion with a narrow center passage connecting right and left chamber portions. When inflated, the narrowed intermediate portion of each such chamber creates a depression or valley, most apparent in a vertical plane, and a dead area on at least one side of the intermediate portion of such chamber passage, most apparent in the horizontal plane.

The method of this invention utilizes the above described apparatus to mobilize the spine and massage, stretch, and relax the musculature and soft tissues of a user's back in a sequential manner from pad bottom to top for a selected time period. The user is placed in a supine position on the apparatus pad, with the user's spinal column extending along the longitudinal centerline of the pad. The two adjacent chambers of the pad lower section, which each have the same transverse cross-sectional area for its length, are positioned to extend across the patient's back beneath the spinal column lumbar vertebrae. The adjacent chambers of the pad upper section are positioned to extend at least partially across the patient's back, with the intermediate portions thereof beneath the spinal column thoracic and cervical vertebrae. The sequential pressure device control system is activated to select the manner in which the chambers are to be sequenced, the time of inflation for each chamber, the total time for the cycles of sequencing, the air compressor of the pneumatic system is started, and the operating pressure for the chamber is selected. Each of the chambers is inflated and deflated in a sequential manner from pad bottom to top for a single cycle and the cycle repeated for the preselected time of operation. Each of the chambers of the pad lower section is sequentially inflated to contact and exert pressure upwardly across the user's back through the lumbar area thereof and raise that portion of the back, including the lumbar vertebrae, for the preselected time and then permitted to deflate. Each of the chambers of the pad upper section is sequentially inflated and the right and left portions expanded to contact and exert pressure upwardly against the patient's back in areas spaced from the spinal column and through the thoracic area thereof. The narrowed intermediate portion of each such chamber extends beneath the thoracic area of the spinal column with little, if any, contact with the thoracic vertebrae by virtue of the depression and dead areas formed by the intermediate portion.

BRIEF DESCRIPTION OF THE DRAWINGS

The nature of the invention will be more clearly understood by reference to the following description, the appended claims and the several views illustrated in the accompanying drawings.

FIG. 4 is a plan view of the therapy pad of this invention in the inflated condition.

FIG. 5 is an enlarged sectional view of the therapy pad taken along the line 5—5 of FIG. 4.

FIG. 6 is an enlarged sectional view of the therapy pad taken along the line 6—6 of FIG. 4.

DESCRIPTION OF THE PREFERRED EMBODIMENT

Figures 1, 7, 8:
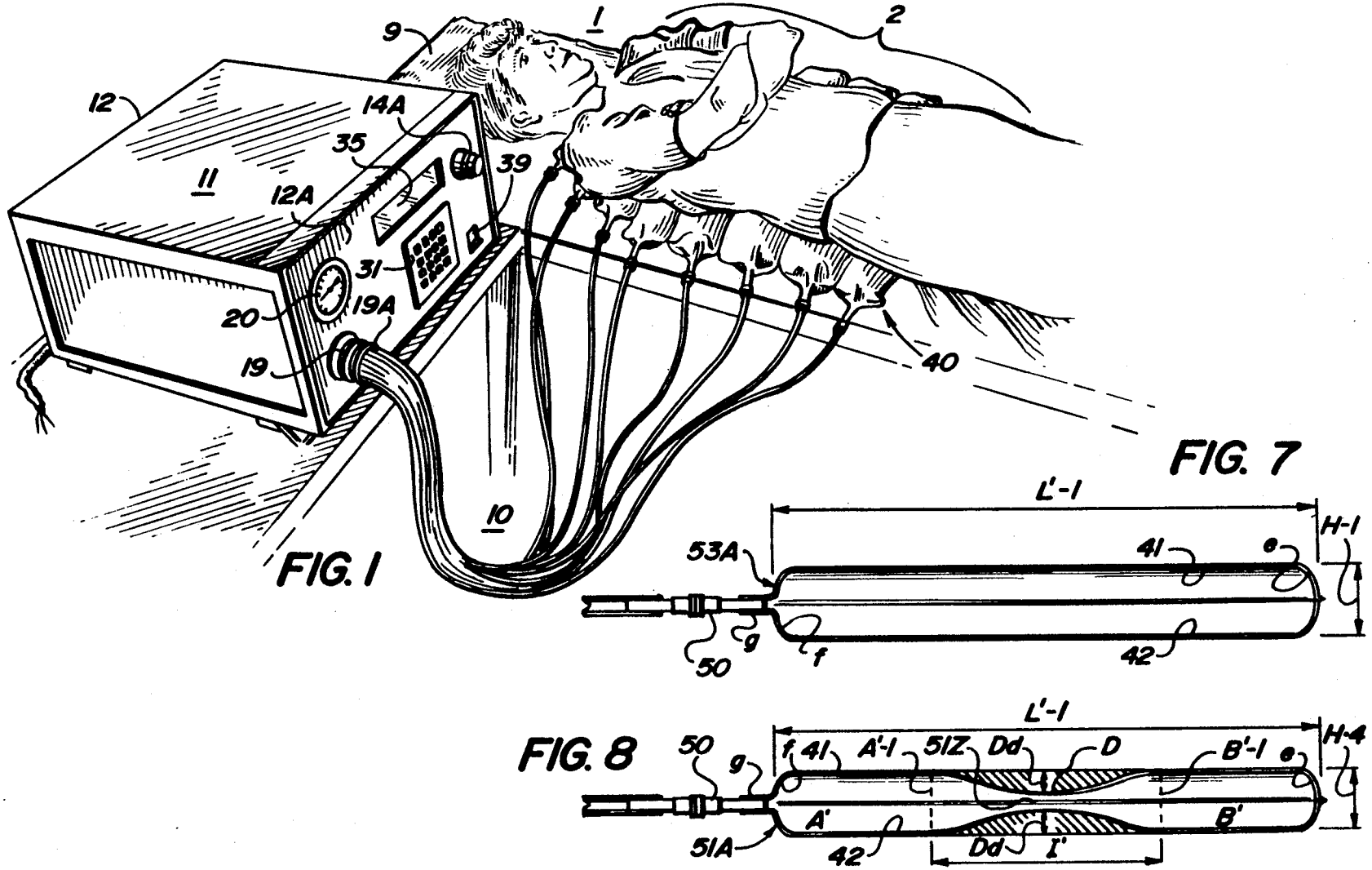
FIG. 1 is a perspective view of the trunk of a patient positioned on a treatment table for treatment by the therapy apparatus of this invention.
FIG. 7 is an enlarged sectional view of one of the chambers of the therapy pad taken along the line 7—7 of FIG. 4.
FIG. 8 is an enlarged sectional view of another of the chambers of the therapy pad taken along the line 8—8 of FIG. 4.

Referring to FIG. 1 there is shown a patient 1 positioned on treatment table 9 and being treated by the therapy apparatus 10 of this invention. Apparatus 10 comprises sequential pressure device 11, including cabinet 12 in which are mounted pneumatic system 15 and control system 30, both shown in the schematic diagram of FIG. 3, and flat pad 40 positioned on treatment table 9 beneath trunk 2 of patient 1.

As best shown in FIGS. 2 and 4–8, pad 40 comprises flat top sheet 41 and flat bottom sheet 42, which in a deflated condition is beneath and in contact with the underside of top sheet 41 Top sheet 41 and bottom sheet 42 are substantially identical in size and shape and made from non-absorbent, flexible, plastic or rubberized material, e.g. polyurethane sheeting, which easily can be cleaned and maintained in a sanitary condition. Sheets 41 and 42 are laid out in substantially the same manner, and the description, including numbers and letters, for top sheet 41 applies equally to bottom sheet 42.

Figure 2:
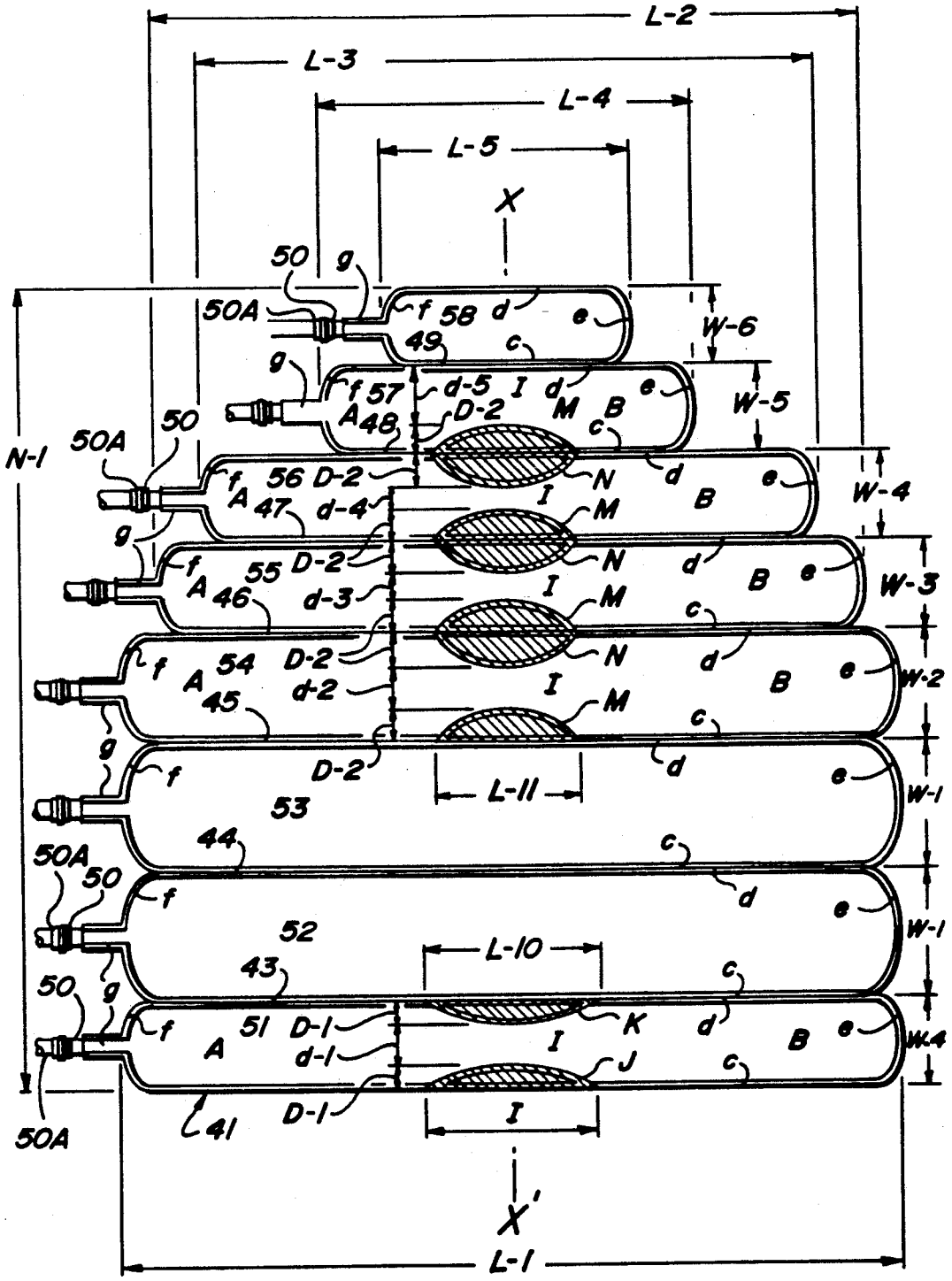
FIG. 2 is a plan view of the top sheet of the inflatable-deflatable therapy pad, which is in a deflated condition, of the apparatus of this invention.

As best shown in FIG. 2, sheet 41 has seams 43–49 which are spaced transverse to longitudinal center line X–X' to form sections 51–58, respectively. Section 51 is at the bottom of sheet 41 and section 58 at the top. Each section has a lower edge c, upper edge d, right end portion e and left end portion f, which includes tube extension portion g. Sections 51–54 are of about the same length L-1 of about 24 inches. Section 55 has a length L-2 of about 22 inches, section 56 has a length L-3 of about 18 inches, section 57 has a length L-4 of about 11 inches, and section 58 has a length L-5 of about 7 inches, each of sections 55–58 being progressively shorter than the adjacent lower section. The widths of sections 51–58 varies Sections 52 and 53 are the widest with a width w-1 of about $4\frac{1}{4}$ inches; section 54 has a width w-2 of about $3\frac{1}{2}$ inches, slightly narrower than width w-1; section 55 has a width w-3 of about $3\frac{1}{4}$ inches, slightly narrower than width w-2; lower section 51 and section 56 have a width w-4 of about 3 inches, slightly narrower than width w-3; section 57 has a width w-5 of about $2\frac{3}{4}$ inches, slightly narrower than width w-4; and top section 58 has a width w-6 of about $2\frac{1}{2}$ inches, slightly narrower than width w-5. Preferably the widths of sections 51–58 should not differ by more than about $\pm\frac{1}{8}$ inch from those stated above. Except for tube extension portions g, top sheet 41 is symmetrical about longitudinal center line X–X'. At about the longitudinal center of section 51 and extending inwardly from lower edge c and upper edge d are arcs J and K, respectively, each having a chord length L-10 of about $5\frac{3}{4}$ inches. On centerline X–X', for section 51 between lower edge c and arc J and between upper edge d and arc K is distance D-1 of about $\frac{3}{4}$ inch. At the center of each of sections 54, 55, and 56 and extending inwardly from lower edge c and upper edge d are arcs M and N, respectively, each having a chord length L-11 of about $4\frac{3}{4}$ inches. On centerline X–X', for each such section between lower edge c and arc M and between upper edge d and arc N is distance D-2 of about $\frac{7}{8}$ inch. At the center of section 57 and extending inwardly of lower edge c is arc M having a chord length L-11 of about $4\frac{3}{4}$ inches. On top sheet centerline X–X' for section 57 between lower edge c and arc M is distance D-2 of about $1\frac{1}{4}$ inches. Preferably the chord lengths of L-10 and L-11 should not differ by more than about $\pm\frac{1}{8}$ inch and the distances D-1 and D-2 should not differ by more than about $\pm 1/16$, inch from those stated above. The areas of section 51 between lower edge c and arc J and between upper edge d and arc K, and of sections 54–56 between lower edge c and arc M and between upper edge d and arc N and of section 57 between lower edge c and arc M arc shaded in FIG. 2. Each two shaded areas for sections 51 have the same dimensions and area. Each of the two shaded areas for sections 54–56 and the one for section 57 have the same dimensions and area.

The overall length of top sheet 41 in a deflated condition is N-1, about $26\frac{1}{2}$ inches. As measured along longitudinal center line X–X', the distance between arcs J and K of section 51 is d-1, about $1\frac{1}{8}$ inches; between arcs M and N of section 54 is d-2, about 1 inch; between arcs M and N of section 55 is d-3, about $\frac{3}{4}$ of an inch; between arcs M and N of section 56 is d-4, about $\frac{1}{2}$ of an inch; and between arc M and upper edge d of section 57 is d-5, about $1\frac{1}{2}$ inches. The arcs formed in sections 51, and 54–57 divide each such section into a left portion A, right portion B, and narrower intermediate portion I, with left portion A and right portion B of each section being about the same length and width.

Top sheet 41 and bottom sheet 42 are heat sealed along seams 43–49, along lower edge c of section 51, along upper edge d of section 58, along right end portions e, along left end portions f, and along tube extensions g, except for their ends which form a passage or opening, not identified, in all of chamber sections 51–58. The heat scaling is shown by the double lines in FIG. 2. A quick-lock adaptor half 50 extends into each passage or opening, not identified, between top and bottom sheet tube extensions g, which are sealed along their edges.

Figure 3:
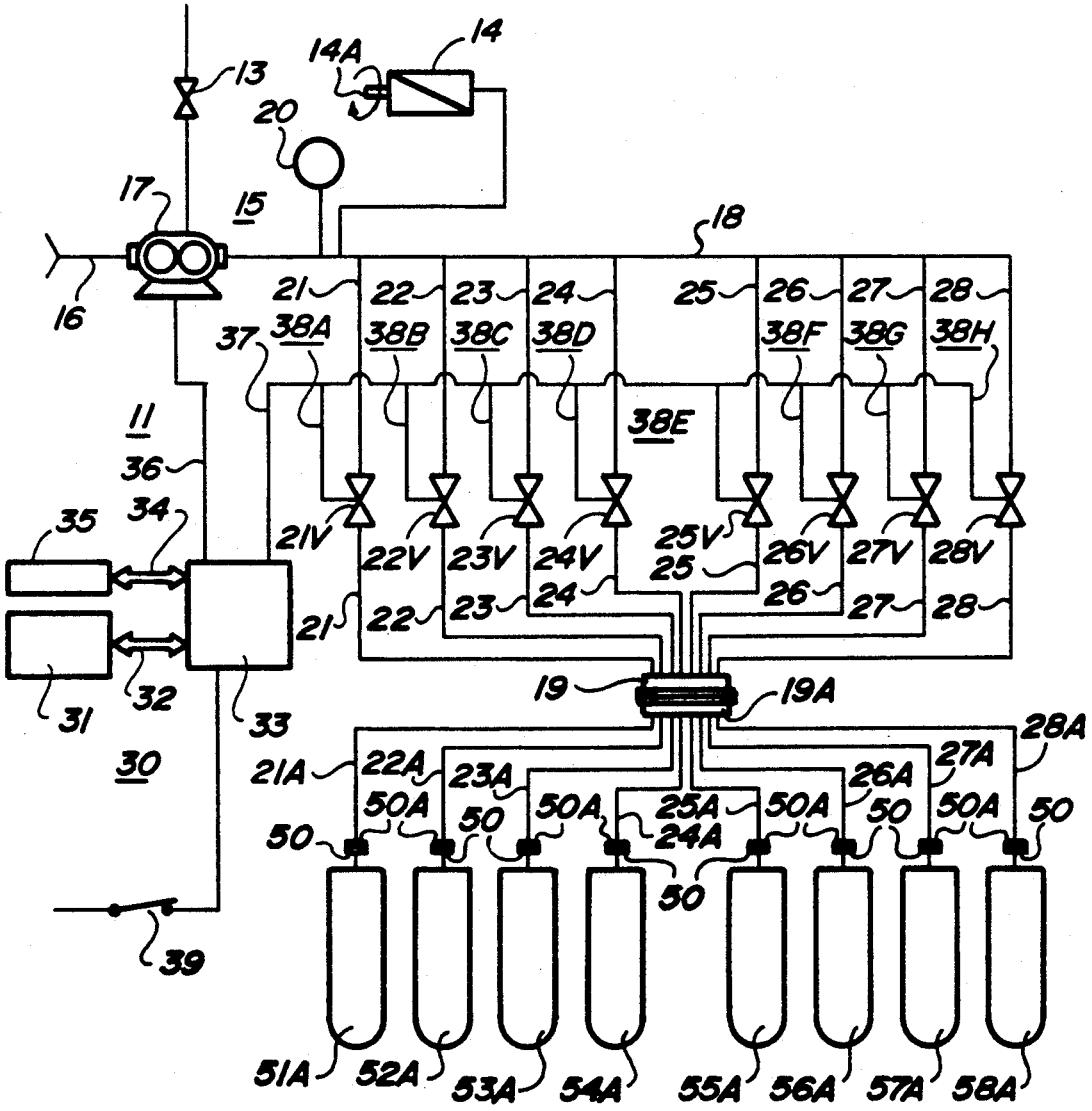
FIG. 3 is a schematic diagram of an embodiment of the apparatus of this invention showing the manner in which the sequential pressure device comprising the pneumatic system and the control system operates in conjunction with the inflatable-deflatable therapy pad.

FIG. 3 is a schematic diagram of the sequential pressure device 11 as used in conjunction with the operation of pad 40 and which comprises pneumatic system 15 and control system 30.

Pneumatic system 15 includes air inlet line 16, air compressor 17, having filters, not identified, at its inlet and discharge ends, compressed air manifold 18 which connects with compressed air feed lines 21–28 that each terminates in multi-tube quick-coupling half 19. Interconnecting with quick-coupling half 19 is multi-tube quick-coupling half 19A to which are connected compressed air feed lines 21A–28A that are extensions of feed lines 21–28, respectively. At the end of each of feed lines 21A–28A is a quick-lock adaptor half 50A which interconnects with a quick-lock adaptor half 50 associated with one of the end portions g of one of sections 51–58, respectively, of top and bottom sheets 41 and 42, respectively, of pad 40. Connected to compressor 17, is emergency relief valve 13, set at a maximum pressure of about 8 p.s.i. Connected with manifold 18 is adjustable relief valve 14, with adjusting knob 14A, and pressure gauge 20. Mounted in feed lines 21–28 are solenoid valves 21V–28V.

Compressor 17 is a rotary vane air compressor, rated at 1.2 C.F.M. at 5 p.s.i. and manufactured by Gast Manufacturing Corporation of Benton Harbor, Mich. Multi-tube quick-coupling halves 50–50A are of a type manufactured by Burron Medical Corporation of Bethlehem, Pa. Solenoid valves 21V–28V are well known to those skilled in the art and each includes a solenoid and a two-position, three-way valve. The two positions are open or close, and the valve has three ports, inlet, discharge, and exhaust.

Control system 30 mounted in cabinet 12 with display panel 12A comprises a user interface device 31, e.g. a keypad which interconnects through line 32 with electronic control sub-system 33. Keypad 31 is a fourteen-button keypad with number buttons 0–9, and buttons for pause, start, clear, and stop. Electronic control sub-section 33 includes a printed circuit board, microprocessor/controller, and related elements, not identified, all well known to those skilled in the control art, and interconnects through line 34 with visual display screen 35, through line 36 with compressor 17, and through line 37 and branch lines 38A–38H with solenoid valves 21V–28V, respectively. Manual on-off rocker-switch 39, connected to a source of power, not shown, provides power to sequential pressure device 11.

During operation of pneumatic system 15, compressed air from air compressor 17 passes through manifold 18, in a manner hereinafter described, through feed lines 21–28, sequentially through valves 21V–28V, quick coupling 19/19A, feed lines 21A–28A and adaptor 50/50A, through tube extensions g and between sections 51–58 of pad top sheet 41 and bottom sheet 42. The compressed air separates sections 51–58 of bottom sheet 41 from sections 51–58 of pad top sheet 42 inflating chambers 51A–58A of pad 40.

In FIGS. 4–6 pad 40 is shown, for illustrative purposes only, with all chambers 51A–58A inflated. With all chambers inflated pad 40 has a length N-2 of about $20\frac{1}{2}$ inches. Each of pad chambers 52A, 53A, and 58A, throughout its length, which extends transverse to pad longitudinal axis X–X', has a uniform transverse cross-sectional area of generally oval, almost round, shape, except at its ends. Chambers 52A, 53A and 58A resemble slightly flattened tubes. FIG. 7 shows a longitudinal cross section 53A. Chambers 52A and 53A have about the same length L'-1, about $22\frac{1}{2}$ inches; about the same width W-1, about 3 inches; about the same height H-1, about $2\frac{5}{8}$ inches; about the same transverse cross-sectional area, i.e. about 6.2 square inches; and are the largest chambers of pad 40. The length L'-1 is wider than the width of the back of almost all patients. Chamber 58A has a length L'-5, about $6\frac{1}{4}$ inches, a width W-6, about $1\frac{7}{8}$ inches; a height H-6, about $1\frac{3}{4}$ inches, a transverse cross sectional area of about 2.6 square inches, and is the smallest chamber of pad 40.

Chambers 51A and 54A–57A have a different configuration than that of chambers 52A, 53A and 58A. Chambers 51A and 54A–57A each has a left portion A', a right portion B' and an intermediate portion I'. Left portion A' and right portion B' of each of chambers 51A and 54A–57A are generally of the same size, i.e. length, width, and height. However, the dimensions of chambers 51A and 54A–57A are somewhat different. Chamber 51A has a length L'-1 of about $22\frac{1}{2}$ inches and for left portion A' and right portion B' a width W-4 of about $2\frac{1}{4}$ inches, a height H-4 of about $2\frac{1}{8}$ inches and a transverse cross sectional area of about 4.52 square inches. Chamber 54A has a length L'-1 of about $22\frac{1}{2}$ inches and for left portion A' and right portion B' a width W-2 of about $2\frac{5}{8}$ inches, a height H-2 of about $2\frac{3}{8}$ inches, and a transverse cross-sectional area of about 4.91 square inches. Chamber 55A has a length L'-2 of about 21 inches, and for left portion A' and right portion B' a width W-3 of about 2⅜ inches, a height H-3 of about 2⅛ and a transverse cross-sectional area of about 3.98 square inches. Chamber 56A has a length L'-3 of about 16 inches and for left portion A' and right portion B' a width W-4 of about 2¼ inches, a height H-4 of about 2⅛ inches, and a transverse cross-sectional area of about 4.52 square inches. Chamber 57A has a length L'-4 of about 10 inches and for left portion A' and right portion B' a width W-5 of about 2 inches, a height H-5 of about 1⅞ inches, and a transverse cross-sectional area of about 2.45 square inches. The width and height of left portion A' and right portion B' of each of chambers 51A and 54A–57A are the dimensions through the transverse cross sections thereof, which are about equal.

In the inflated condition of pad 40, the intermediate portion I' of each of chambers 51A and 54A–57A is narrower at its center and in a horizontal plane extending through the longitudinal center line of each such chamber, than its adjacent left portion A' and right portion B' by virtue of the heat sealing of arc M of chamber 57A, the two arcs M and N of chambers 54A–56A, and the two arcs J and K of chamber 51A. In chamber 57A the area between heat sealed bottom edge c and arc M, is a flat, dead area and will not inflate. By virtue of heat sealing there is also a flat, dead area between top edge d and arc N and bottom edge c and arc M of chambers 54A–56A and between top edge d and arc K and bottom edge c and arc J of chamber 51A. These flat, dead areas are shaded in FIG. 4, which shows pad 40 in the inflated condition, and are also shaded in FIG. 2, which shows pad 40 in a deflated condition. These shaded areas maintain about the same dimensions in both the inflated and deflated condition of pad 40. The intermediate portion I' of each of chambers 51A and 54A–57A narrows or tapers, as best shown for chambers 54A–57A in FIG. 4 and better shown for chamber 51A in FIG. 8. The narrowing or tapering begins at inner ends A'-1 and B'-1 of each chamber portion A' and B', respectively, and extends toward the chamber center lying on pad longitudinal center line X–X'.

For chamber 51A, intermediate portion I' has a length I'L of about 8 inches between inner end A'-1 of chamber portion A' and inner end B'-1 of chamber portion B'. For chamber 54A, intermediate portion I' has a length I'L of about 7 inches between inner end A'-1 of chamber portion A' and inner end B'-1 of chamber portion B'. For chamber 55A, intermediate portion I' has a length I'L, not identified, of about 6 inches; for chamber 56A intermediate portion I' has a length I'L, not identified, of about 5½ inches; and for chamber 57A, intermediate portion I' has a length I'L, not identified, of about 5 inches. The narrowing or tapering of the intermediate portion I' of each of chambers 51A and 54A–56A imparts an hour-glass configuration to each such chamber, i.e. larger at both ends and narrower in the center. As best shown in FIGS. 4 and 6, the sealing of arcs M of chamber 57A causes it to narrow only along the upper edge D.

As a result of the above described construction, each of chambers 51A and 54A–57A has a small passage or opening through the center of its intermediate portion I' of generally transverse oval, almost circular, shape. Chamber 51A has passage 51Z with a width of about ¾ inch and a transverse cross-sectional area of about 0.44 square inch. Chamber 54A has passage 54Z with a width of about ⅞ inch and a transverse cross-sectional area of about 0.60 square inch. Chamber 55A has passage 55Z with a width of about ⅝ inch and a transverse cross-sectional area of about 0.31 square inch. Chamber 56A has passage 56Z with a width of about ½ inch and a transverse cross-sectional area of about 0.20 square inch. Chamber 57A has passage 57Z with a width of about 1⅛ inch and a transverse cross sectional area of about 1.0 square inch. For chambers 51A and 54A–56A each of their longitudinal centerlines, not identified, extends centrally through left portion A', right portion B' and intermediate portion I', including passages 51Z, 54Z, 55Z, and 56Z, respectively. For chamber 57A, the longitudinal centerline through left portion A' and right portion B' is offset horizontally from the longitudinal centerline through intermediate portion I' including passage 57Z. Each of passages 51Z, 54Z-57Z is of a size to effect about simultaneous inflation of the left portion A' and right portion B' of its respective chamber to ensure that both portions inflate in about the same time period. A further result of the hour-glass configuration of intermediate portion I' of chambers 51A and chambers 54A–56A is the creation of a void or depression D about each such intermediate portion I' except through a horizontal plane extending through the longitudinal centerline of each such chamber in which top sheet 41 and bottom sheet 42 are sealed to form dead spaces on each side of the intermediate portion I.

In FIG. 8, which is a vertical sectional view through the longitudinal centerline of chamber 51A, void or depression D is shown shaded above and below intermediate portion I'. At the center of I', depression or void D has a depth Dd of about ¾ of an inch. In FIG. 6, which is a vertical sectional view through the longitudinal centerline of pad 40, depression or void D is shown shaded to illustrate that it extends for almost 360° about the periphery of intermediate passage 51Z. In a horizontal plane through the longitudinal centerline of chamber 51A, the heat sealing of top pad 41 and bottom pad 42 along lower edge c and arc J and upper edge d and arc K form dead areas on each side of a major portion of chamber intermediate portion I', as best shown in FIG. 4. Similarly as shown in FIG. 6, each of chambers 54A, 55A and 56A has void or depression D about openings 54Z, 55Z, and 56Z, respectively. Depth Dd for both voids or depressions D of chambers 54A, 55A and 56A is about 1 inch. For chamber 57A, with passage 57Z located along the upper portion of such chamber, depth Dd for void or depression D is measured in a vertical plane extending through the longitudinal centerline of passage 57Z at the center of the chamber to horizontal planes extending tangentially of the top center and bottom center of chamber 57A. Thus, in a vertical plane extending through the longitudinal centerline of chambers 51A and 54A–56A there are depressions D shown above and below passages 51Z and 54Z–56Z, respectively, of intermediate portions I' of such chambers and in a horizontal plane through such centerline dead spaces, shaded in FIG. 4, on either side of such passages. In a vertical plane extending through the longitudinal centerline of passage 57Z of chamber 57A there are depressions D above and below passage 57Z and in a horizontal plane through such centerline a dead space on only the lower side of such passage adjacent chamber 56A.

The operation of therapy apparatus 10 is initiated by a user moving rocker switch 39, which is located on display panel 12A of cabinet 12, to the on-position. The user is guided through a series of displays or options programmed into the electronic control sub-system 33 of sequential pressure device 11 to enter all desired information or parameters before operation of pad 40 is begun. The menu or options appear on visual display screen 35. Menu 1 offers "back" appliance option only, but others may be added. Menu 2 enters "chamber" options, i.e. single-chamber, double-chamber, triple-chamber, which corresponds to the number of chambers to be inflated during a cycle of the sequential inflation of chambers 51A–58A of pad 40. If single chamber option is elected, each of chambers 51A–58A is inflated by itself sequentially, i.e. 51A, 52A, 53A etc. until the cycle through chamber 58A is completed. If double or triple-chamber option is elected the chambers are sequentially inflated in a staggered manner as hereinafter described. Menu 3 offers an option of the time or duration that each chamber is, or chambers are, to be inflated, i.e. fast, e.g. 3 seconds/chamber, medium, e.g. 6 seconds/chamber, or slow, e.g. 9 seconds/chamber. Menu 4 permits a choice of operation time in minutes for the number of cycles or period that sequential inflation of pad chambers 51A–58A is to occur. Knob 14A is turned to set the operating pressure of the compressed air to be fed to chambers 51A–58A, at a preferred range of between 3 to 5 p.s.i., maximum 8 p.s.i. depending upon several variables, including the weight of patient 1.

The sequential inflation of chambers 51A–58A creates the appearance of a wave moving through pad 40. The moving wave may be described as having four attributes, speed, width, amplitude, and direction. The speed of the wave relates to how fast it travels through pad 40 and is a function of the time period that each chamber is, or double chambers or triple chambers are, inflated. As mentioned above, for menu 3, three speeds are available, 3 seconds per chamber, 6 seconds per chamber or chambers, or 9 seconds per chamber or chambers. The width of the wave relates to the maximum number of chambers inflated during a sequence. This relates to the choice of menu 2, i.e., single chamber, double-chamber, or triple chamber. The amplitude of the wave relates to the maximum air pressure to be fed to a particular chamber. This variable is established by rotation of knob 4A on panel 12A. Safety relief valve 13 and the capabilities of compressor 17 prevent the system pressure from exceeding 8 p.s.i. The sequencing of inflation of chambers 51A–58A and the movement of the wave through pad 40 progresses from bottom chamber 51A to top chamber 58A then repeats the sequence from bottom to top until the operating time or time for the number of cycles and total period of sequencing desired is completed.

Figure 9:
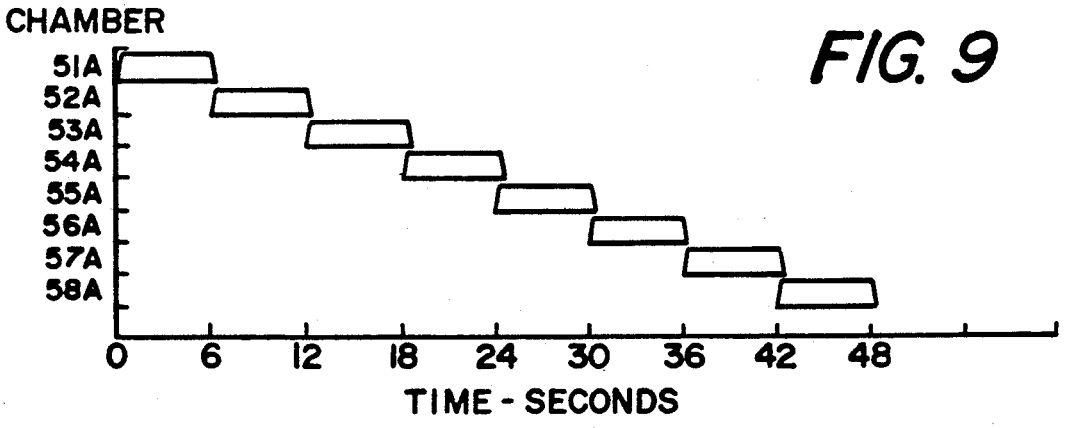
FIGS. 9–11 are charts showing the inflation-deflation intervals of the chambers of the pad of this invention, for a single cycle of the operation of the pad for one-chamber, two-chamber and three chamber sequency.

To initiate operation of pad 40, switch 39 is moved to the "on" position, the appropriate buttons of keypad 31*a* of sequential pressure device 11 are pressed and the desired air pressure is selected by turning knob 14A. For example, a pressure of about 5 p.s.i. is selected, then single-chamber sequencing is selected for menu 2, medium—6 seconds/chamber inflation for menu 3, 8 minute operation time, i.e. 10 cycles for menu 4, and the start button is pressed to initiate operation. Compressor 17 starts and feeds air at a pressure of about 5 p.s.i. through manifold 18 and feed lines 21–28 to solenoid valves 21V–28V. Valve 21V is moved to the open-port position by the programming of electronic control sub-system 33 and compressed air rapidly passes through the open-port of valve 21V, the continuation of line 21, multi-tube coupling 19/19A, line 21A, quick-lock adaptor 50/50A into chamber 51A and inflates it. Valve 21V remains in the open-port position for 6 seconds then moves to the closed-port position at which time the compressed air from chamber 51A slowly exhausts through the valve exhaust port to the atmosphere permitting chamber 51A to slowly deflate. At the moment valve 21V is moved to the closed-port position by electronic control sub-system 33, it also signals solenoid valve 22V to move to the open-port position and compressed air rapidly passes through the open-port of valve 22V, the continuation of line 22, multi-tube coupling 19/19A, line 22A, quick-lock adaptor 50/50A into chamber 52A, and inflates it. Chamber 52A is inflated before chamber 51A is completely deflated. Valve 22V remains in the open-port position for 6 seconds then moves to the closed-port position at which time the compressed air from chamber 52A slowly passes through the valve exhaust port to the atmosphere permitting chamber 52A to slowly deflate. Each of valves 23V–28V is caused to operate in an identical manner for 6 seconds to cause chambers 53A–58A to sequentially, rapidly inflate and then slowly deflate until one cycle of operation of pad 40 is completed. The sequential inflation and deflation of chambers 51A–58A gives the appearance of a wave moving from the bottom to the top of pad 40. The sequential inflation-deflation of chambers 51A–58A continues through nine more cycles until the operating time of 8 minutes, i.e. 10 cycles is completed. FIG. 9 graphically illustrates the manner in which chambers 51A–58A inflate and deflate, each for an interval of 6 seconds, for a total cycle time of 48 seconds.

If double-chamber staggered, overlapping sequencing of chambers 51A–58A is desired, the appropriate buttons of keypad 31 are pressed for that option of menu 2. Medium speed 6 seconds/chamber may be selected for menu 3, a running time of 9 minutes, i.e. 20 cycles, is selected for menu 4 and start button 39 is pressed to the "on" position to initiate operation. Compressor 17 starts and feeds air at a pressure of about 5 p.s.i. through manifold 18 and feed lines 21–28 to solenoid valves 21V–28V. Valve 21V is moved to the open-port position for 6 seconds by the programming of electronic control sub-system 33 and compressed air rapidly passes through the open-port of valve 21V, the continuation of line 21, multi-tube coupling 19/19A, line 21A, quick-lock adaptor 50/50A into chamber 51A and inflates it. Valve 21V remains in the open-port position for 6 seconds then moves to the closed-port position at which time the compressed air from chamber 51A slowly exhausts through the valve exhaust port permitting chamber 51A to slowly deflate. After valve 21V has been open for 3 seconds the electronic control sub-system 33 signals solenoid valve 22V to move to the open-port position and compressed air rapidly passes through the open-port of valve 22V, the continuation of line 22, multi-tube coupling 19/19A, line 22A, quick-lock adaptor 50/50A into chamber 52A, and inflates it. Valve 22V remains in the open-port position for 6 seconds and switches to the closed-port position, at which time the compressed air from chamber 52A slowly passes through the valve exhaust port permitting chamber 52A to slowly deflate. Valves 23V–28A are each caused to operate in an identical manner for 6 seconds to cause chambers 53A–58A to sequentially, in a staggered, overlapping manner, inflate and then deflate and complete one cycle.

Figure 10:
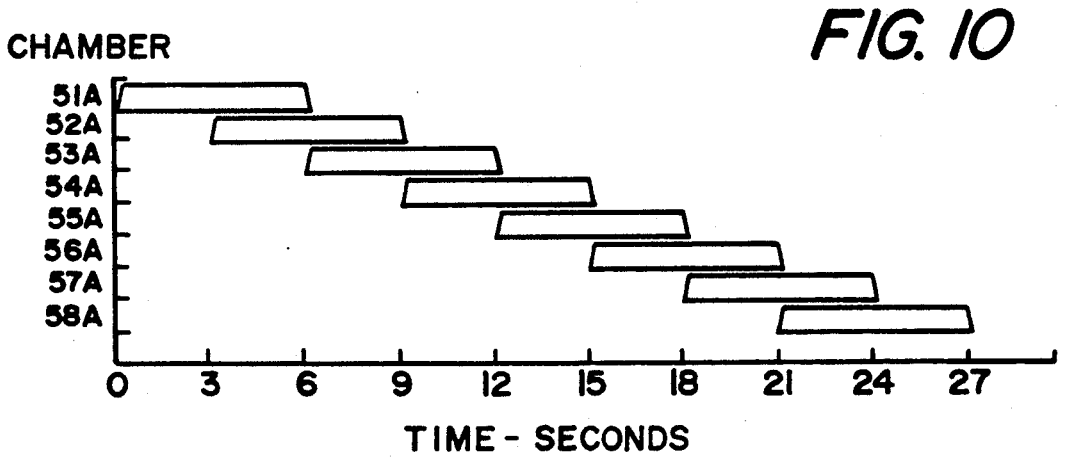

As shown graphically in FIG. 10, the ending 3 second inflation portion of the 6 second inflation period for chamber 51A is overlapped by the beginning 3 second inflation portion of the 6 second inflation period of chamber 52A and chambers 51A and 52A are both inflated in an overlapping manner during the 3 to 6 second portion of each pad inflation/deflation cycle of 27 seconds. In similar fashion, chambers 52A and 53A, 53A and 54A, 54A and 55A and 56A, 56A and 57A and 57A and 58A are both inflated for an overlapping portion of their inflation periods. Chamber 51A is inflated by itself for a 3 second period at the start of each cycle and chamber 58A is inflated by itself for a 3 second period at the end of each cycle. The double-chamber staggered, overlapping sequencing continues for 20 cycles until the end of the selected running time of 9 minutes for menu 4.

Figure 11:
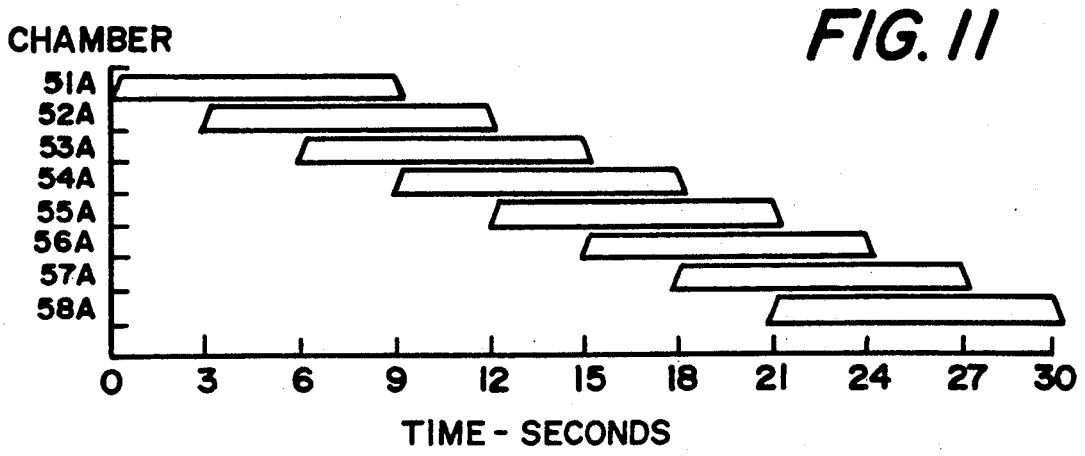

When triple-chamber staggered, overlapping sequencing of chambers 51A–58A is desired, the appropriate buttons of keypad 31 are pressed for that option of menu 2. Slow speed of 9 seconds/chamber may be selected for menu 3, a running time of 10 minutes, i.e. 20 cycles, may be selected for menu 4, and start button 39 is pressed to initiate operations. Compressor 17 starts feeding air at 5 p.s.i. through pneumatic system 15 and the control system 30 operates in a manner similar to that described above for the single chamber and double chamber sequencing. FIG. 11 graphically illustrates the manner in which chambers 51A–58A inflate and deflate for triple-chamber staggered, overlapping sequencing. Chamber 51A is inflated for 9 seconds and then deflates. After chamber 51A has been inflated for 3 seconds, chamber 52A is inflated for 9 seconds. The ending 6 second inflation portion of the 9 second inflation period for chamber 51A is overlapped by the beginning 6 second inflation portion of the 9 second inflation period of chamber 52A and chambers 51A and 52A are both inflated during the 3–9 second period of the pad inflation cycle of 30 seconds. After chamber 51A has been inflated for 6 seconds and chamber 52A has been inflated for 3 seconds, chamber 53A is inflated for 9 seconds. The ending 3 second inflation portion of the 9 second inflation period of chamber 51A is overlapped by the beginning 3 second inflation portion of the 9 second inflation period of chamber 53A. The ending 6 second inflation of the 9 second inflation period of chamber 52A is overlapped by the beginning 6 second inflation portion of the 9 second inflation period of chamber 53A during the 6 to 12 second period of the pad inflation cycle of 30 seconds. The triple-chamber staggered sequencing continues for 20 cycles until the end of the running time of 10 minutes selected for menu 4. Chamber 51A is inflated by itself for a 3 second at the start of each cycle and overlaps the initial 6 seconds of inflation of chamber 52A and the initial 3 second inflation of chamber 53A. Similarly the inflation period of chamber 52A overlaps a portion of the inflation periods of chambers 53A and 54A, etc.

The manner in which pad 40 is used to treat patient 1 is best shown in FIGS. 12–16. Patient 1 is placed in a supine position on treatment table 9 with trunk 2 of back 30 on top of deflated pad 40 so that spinal column 4 is positioned along its longitudinal centerline X–X'. Spinal column 4 comprises upper cervical portion C, thoracic portion T, lumbar portion LU, and sacrum 5 and coccyx 6. As viewed laterally cervical portion C has a slight inward or concave curve and includes seven cervical vertebrae, which are the smallest vertebrae in column 4. Thoracic portion T has a distinct outward or convex curve and includes twelve thoracic vertebrae, which from top to bottom are progressively larger in size. Lumbar portion LU has a prominent inward or concave curve and includes five lumbar vertebrae, which are larger than those of the cervical and thoracic portions C and T, respectively.

Figure 13:
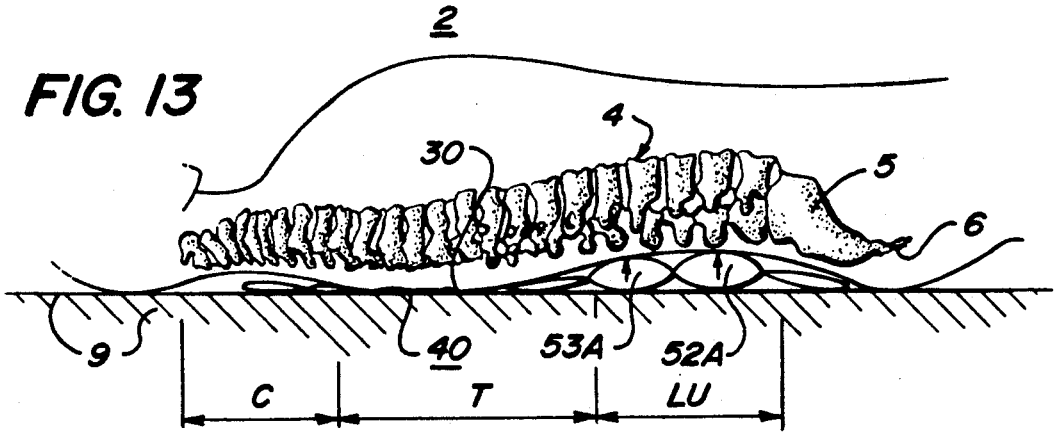
FIG. 13 is a cross-sectional view of the pad and torso of FIG. 12 taken along the line 13—13 of FIG. 12 and showing two chambers inflated and the remainder of the chambers deflated.
Figure 12:
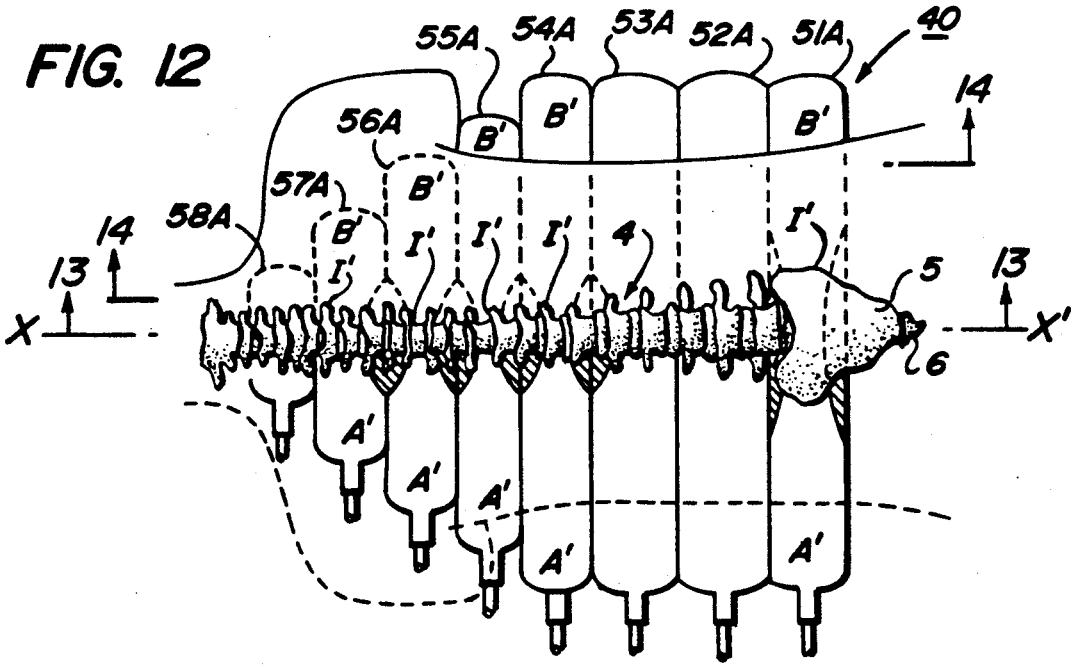
FIG. 12 is a plan view of the therapy pad of this invention with a schematic rendition of a patient's torso, partially in phantom, positioned on the pad, which is in the deflated condition, and showing the patient's spine.

As shown in FIGS. 12 and 13, the vertebrae of spinal column 4 are structurally strongest and heaviest in lumbar portion LU and progressively less strong and smaller through the thoracic portion T and cervical portion C. Pad 40 is designed in a somewhat similar manner. As shown in FIG. 2, sections 52–54 of top and bottom sheets 41 and 42 arc the longest and widest pad sections, while sections 55–58 are progressively shorter and narrower. Lowest section 51 is as long as sections 52–54 but not as wide. Sections 52 and 53 of top and bottom sheets 41 and 42 form chambers 52A and 53A, which are the largest chambers and have the greatest transverse cross-sectional areas.

Figure 14:
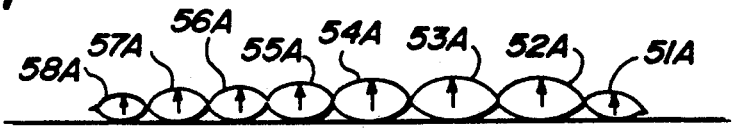
FIG. 14 is a cross-sectional view only of the therapy pad of this invention taken along the line 14–14 of FIG. 12 with all of the chambers inflated.

When chambers 52A and 53A of pad 40 are inflated as shown in FIG. 13, they first expand to occupy a portion of the space between treatment table 9 and the space beneath back 3 in the lumbar portion LU of spinal column 4, which has an inward curve. More importantly, as chambers 52A and 53A continue to expand to their full size, the upper surfaces of the chambers exert upward pressure, in the direction shown by the arrows, against back 3 in the areas adjacent lumbar portion LU of column 4 across the width of back 3. In FIG. 14 chambers 51A–58A are all shown inflated only to illustrate the manner in which each chamber expands to exert upward pressure against back 3 in the direction shown by the arrows. The height of the chambers are largest across back lumbar portion LU, i.e. chambers 52A and 53A, and become progressively smaller in the upper portion of the pad, i.e. chambers 54A–58A, in the thoracic portion T and cervical portion C. As best shown in FIG. 12, the narrowed intermediate portion I' of chamber 51A is positioned beneath sacrum 6, and the narrowed intermediate portions I' of chambers 53A–57A are positioned beneath the vertebrae of spinal column thoracic portion T and the lower part of cervical portion C. Chamber 58A is positioned beneath cervical portion C.

Figure 15:
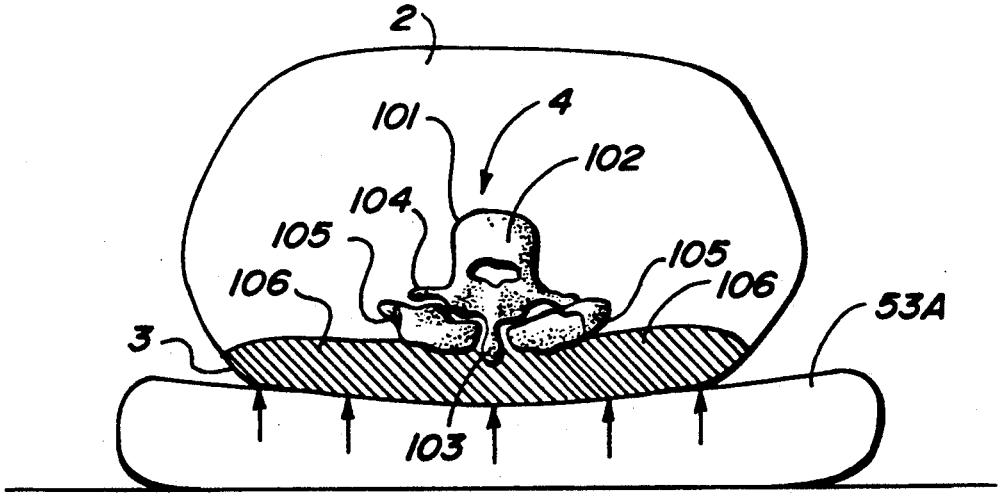
FIG. 15 is a schematic cross-section through the lumbar portion of a patient's torso showing the manner in which a pad chamber extending through that area contacts the surface of the back.

FIG. 15 schematically illustrates a cross-section of trunk 2 through lumbar portion LU of spinal column 4. In lumbar portion LU, lumbar vertebrae 101 includes body 102, spinous process 103, and transverse process 104. Para lumbar musculature 105 extends adjacent both sides of spinal column 4 along each side of spinous process 103, and fascia and soft tissue 106, extends across an extensive area, shaded, of back 3 between its outer surface and spinous process 103 of lumbar vertebrae 101.

Figure 16:
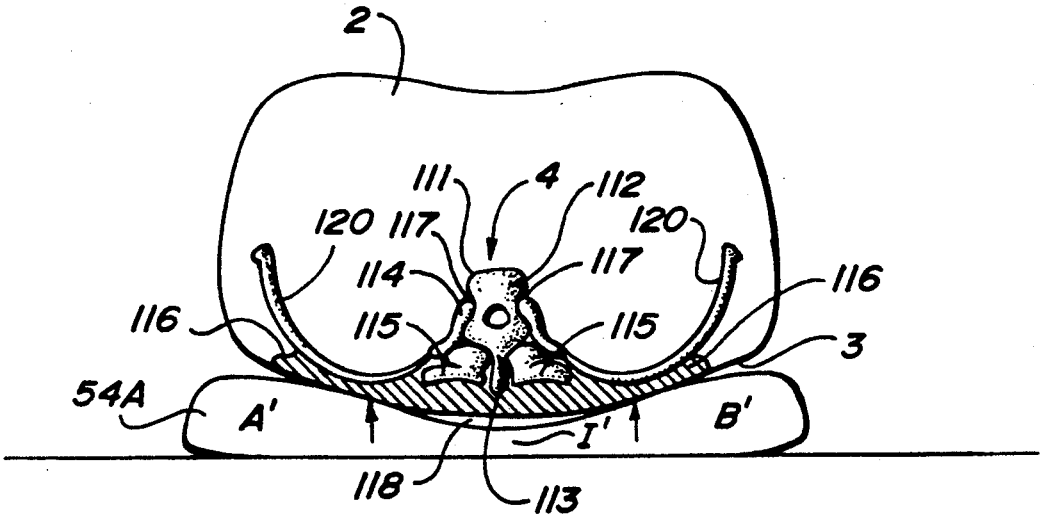
FIG. 16 is a schematic cross-section through the thoracic portion of a patient's torso showing the manner in which a pad chamber extending through that area contacts the surface of the back.

FIG. 16 schematically illustrates a cross section of trunk 2 through thoracic portion T of spinal column 4. In thoracic portion T, thoracic vertebrae 111 includes body 112, spinous process 113 and transverse process 114. Ribs 120 connect with thoracic vertebrae 111 at the costovertebral joint 117 and extend toward back 3 and around trunk 2 in the usual cage shape well known to those knowledgeable about anatomy. Para thoracic musculature 115 extends adjacent both sides of spinal column 4, along each side of spinous process 113, and fascia and soft tissue 116 extends across an extensive area, shaded, of back 3 between its outer surface and spinous process 113 of thoracic vertebrae 111 and ribs 120.

As illustrated in FIGS. 15 and 16, lumbar vertebrae 101 is larger than thoracic vertebrae 111 and spinous process 103 of lumbar vertebrae 101 is a greater distance from the surface of back 3 then is spinous process 113 of thoracic vertebrae 111. Para lumbar musculature 105 and fascia and soft tissue 106 adjacent lumbar vertebrae spinous process 103 and between it and the surface of back 3 is larger and more dense than para thoracic musculature 115 and fascia and soft tissue 116 adjacent thoracic vertebrae spinous process 113 and the surface of back 3. This comparison is equally true for all the vertebrae, musculature, fascia and soft tissue adjacent spinal lumbar portion LU as compared to that of spinal column thoracic portion T and cervical portion C. Specifically, the musculature, fascia and soft tissue is greater and much more dense and the spinous processes of the vertebrae are further from the surface of back 3 in the lower area of the back, i.e. lumbar, than in the upper areas of the back, i.e. thoracic and cervical.

Therapy apparatus 10 operates to mobilize and massage the paravertebral musculature of back 3 of user 1 experiencing back problems. Chambers 51A–58A are inflated in a sequential manner, either single, double or triple-chamber option, to effect relaxation of the user's musculature and mobilize the vertebrae in an up/down motion. As shown in FIGS. 5, 6, 13 and 14, inflated chambers 51A–58A, through transverse sections thereof, conform generally to the normal curvature of spinal column 4, particularly with respect to intermediate portions I' of chambers 51A and 54A–57A. Chamber 51A expands across back 3 and under the upper portion of sacrum 5. The largest chambers 52A and 53A expand upwardly into contact with back 3 above them and conform to the prominent inward curvature of the lumbar portion LU of spinal column 4. Chambers 54A–57A progressively decrease in width and height to top chamber 58A, to conform to the outward curve of back thoracic portion T of spinal column 4. Chambers 51A–54A have the greatest length L'-1 of about 22½ inches, which is sufficiently long to provide support across the sacrum, lumbar, and lower thoracic vertebrae portions of a normal patient's back, where such person's weight is concentrated and where the greatest rising or lifting action of pad 40 occurs. Chambers 55A–58A have progressively shorter lengths L'-2 to L'-5, respectively, which combined with their progressively smaller widths W'-3 to W'-6, and heights H-3 to H-6, respectively, apply less lift action for sequentially raising the thoracic portion T and lower cervical portion C of spinal column 4 of the back 3 of a patient.

As best shown in FIGS. 2, 4 and 6, pad sheets 41 and 42 and their sections 52, 53 and 58, which inflate to form pad chambers 52A, 53A, and 58A are designed to have substantially uniform transverse cross-sections for the major portions of the lengths L'-1 for chambers 52A and 53A and L'-5 for chamber 58A. Inflation of chamber 52A in FIG. 15 illustrate the manner in which chamber 52A and 53A act upon the vertebrae in the lumbar portion LU of spinal column 4. For example, the weight of torso 2 on a major portion of chamber 53A causes it to distort somewhat but the pressure of air causes the chamber to expand and exert an upward pressure on the portion of back 3 above such chamber, in particular upon para lumbar musculature 105 fascia and soft tissue 106 and lumbar vertebrae 101 in that portion of back 3, forcing them upwardly from their normal position. The strength and thickness of musculature 105 and soft tissue 106 and the distance of the end of spinous process 103 from the top surface of such chamber permits them to be moved upward by large chambers 52A and 53A a greater distance than occurs above the lumbar area of the back. While top chamber 58A has a uniform transverse cross-section, it has the shortest length L'-5, and the smallest width W-6 and height H-6 and is designed to raise the vertebrae above it only a short distance equal to chamber height H-6.

As best shown in FIGS. 2, 4 and 6, pad sheets 41 and 42 and their sections 51 and 54–57, which inflate to form pad chambers 51A and 54A–57A are designed specifically to have intermediate portions I' form a void or depression D about the intermediate portion of each such chamber and dead areas adjacent thereto in a horizontal plane. Void or depression D of chamber 51A is best shown in FIG. 8 and for chamber 54A is shown in FIG. 16. The voids and dead areas for chambers 55A and 56A and somewhat for chamber 57A are similar to that of chambers 51A and 54A. Inflation of chamber 51A causes chamber left portion A' and right portion B' to expand and move upwardly, raise the portion of back 3 and sacrum 5 above chamber 51A and massage and relax the musculature, fascia and soft tissue on either side of sacrum 5. Voids D and the dead areas adjacent center portions I' of chamber 51A, particularly at the center thereof, act to avoid or minimize contact of the chamber with the bony prominences of sacrum 6 and relieve or avoid placing any undue pressure on sacrum 6. Inflation of chamber 54A, as best shown in FIG. 16, causes chamber left portion A' and right portion B' to expand upwardly, exerting pressure in the direction of the arrows and raising the portion of back 3 above chamber 54A, including thoracic vertebrae 111 and ribs 120, and massage and relax thoracic musculature 115 and fascia and soft tissue 116. Voids D and the dead areas adjacent intermediate portion I' of chamber 54A, particularly at the center thereof, act to avoid or minimize contact of the intermediate portion I' with spinous process 113 of thoracic vertebrae 111 by virtue of voids or space 118 between intermediate portion I' and back 3 at the center of chamber 54A. The above described construction of the progressively smaller chambers 54A–57A results in limited upward pressure and raising of back 3 in the areas above such chambers and on either side of the thoracic portion T of spinal column 4.

The voids or depressions D and the dead areas adjacent the intermediate portions I' of chambers 54A–57A act to minimize or avoid contact of such intermediate portions with back 3 above them. The voids and dead areas act to avoid to a large extent, if not entirely, pressure being exerted upon, and irritation, of the bony prominences of the vertebrae of thoracic portion T and lower vertebrae of cervical portion C. At the same time, the uniform pressure exerted laterally and upwardly by chamber portions A' and B' on those portions of back 3 above them, which are spaced from the vertebrae of spinal column 4, utilizes the ribs 120 as a fulcrum in mobilizing the vertebrae of spine thoracic portion T due to the anatomic articulation to such vertebrae at the costo-vertebral joints 117. This occurs with minimized lifting of the vertebrae 111 and ribs 120. The sequential inflation and deflation of the chambers of pad 40 to exert upward pressure and lifting of localized areas of back 3 acts to mobilize spinal column 4 and massage, stretch, and relax the musculature and soft tissue upon which such chambers act.

In another embodiment of the invention, not shown, the inner and outer portions A' and B' for chambers 51A and 54A–57A may have an intermediate portion I' of cylindrical shape for the length thereof. The intermediate portion I' may also be positioned to extend between inner and outer portions A' and B' offset from, e.g. below, the longitudinal centerline thereof. This construction creates a void or depression of a larger dimension to one side or above the top surface of the cylinder intermediate portion described above for the preferred embodiment. In the preferred embodiment of the invention, in a vertical plane extending through the longitudinal centerline of chamber 51A and 54A–56A the combined dimension Dd and the voids or depression D above and below the centers of the intermediate portion I' are 1½ inches for chamber 51A and 2 inches for chamber 54A–56A. In similar fashion the combined dimension Dd for the void or depressions D above and below the center of the intermediate portion I' for chamber 57A is about 1 inch.

The apparatus and method of this invention has been described above in a preferred manner. It will be recognized that those skilled in the art can make modifications and variations to the apparatus and method without departing from the spirit and scope thereof as defined in the appended claims.

We claim:

1. A pad having a longitudinal centerline and formed with a plurality of inflatable and deflatable adjacent chambers extending transverse to the pad centerline for treatment of the back of a patient placed thereon in a supine position, comprising:

(A) a lower section comprising a plurality of chambers including:

(1) a first elongated chamber having a substantially uniform cross-sectional area for the length thereof, (2) a second elongated chamber adjacent the first elongated chamber and having a substantially uniform cross-sectional area for the length thereof; and (B) an upper section comprising a plurality of chambers including:

(1) first, second and third adjacent chambers, each having:

(a) first and second spaced outer portions each having a first substantially uniform transverse cross-sectional area for a major portion of the length thereof, (b) an intermediate portion having a passage with a second transverse cross-sectional area smaller than the first transverse cross sectional area of the first and second spaced outer portions, communicating therewith, and forming between the first and second outer portions a void about the intermediate portion.

2. The pad according to claim 1 wherein the length of the intermediate portion of the upper section first chamber is at least 4¾ inches.

3. The pad according to claim 1 wherein the pad lower section first and second chambers have about the same substantially uniform cross sectional area for the length thereof.

4. The pad according to claim 1 wherein the pad lower section first chamber expands to a height at least 2⅝ inches.

5. The pad according to claim 1 wherein the lower section includes a third chamber adjacent said lower section first chamber and having:

(A) first and second outer portions each having a first substantially uniform transverse cross-sectional area for the length thereof, and (B) an intermediate portion having a passage with a second transverse cross-sectional area smaller than the first transverse cross-sectional area of the first and second spaced outer portions, communicating therewith, and forming between the first and second outer portions a void about the intermediate portion.

6. The pad according to claim 1 wherein the transverse cross-sectional area of the upper section first chamber first and second outer portions is smaller than the transverse cross-sectional area of the pad lower section first chamber first and second outer portions.

7. The pad according to claim 6 wherein the first and second outer portions of the upper section first chamber expand to a height at least 2⅜ inches.

8. The pad according to claim 6 wherein the transverse cross-sectional areas of the pad upper section first chamber first and second outer portions are larger than the transverse cross-sectional areas of the first and second outer portions of the pad upper section second chamber.

9. The pad according to claim 18 wherein the transverse cross-sectional areas of the upper section second chamber first and second outer portions are larger than the transverse cross-sectional areas of the upper section third chamber first and second outer portions.

10. The pad according to claim 1 wherein the first and second spaced outer portions of the upper section first chamber expand to a height less than the height of expansion of each of the lower section first and second chambers.

11. The pad according to claim 1 wherein the spaced first and second outer portions of the upper section second and third chambers expand to a height less than the height of expansion of the spaced first and second outer portions of the upper section first chamber.

12. The pad according to claim 1 wherein the pad upper section comprises a fourth chamber adjacent the pad upper section third chamber including:

(A) first and second spaced outer portions each having a first substantially uniform transverse cross-sectional area for the length thereof, and (B) an intermediate portion having a passage with a second transverse cross-sectional area smaller than the first transverse cross-sectional area of the first and second spaced outer portions, and forming between the first and second spaced outer portions a void about the intermediate portion.

13. The pad according to claim 12, wherein the pad upper section further comprises an elongated fifth chamber having a substantially uniform cross-sectional area for the length thereof.

14. A pad having a longitudinal centerline and formed with a plurality of inflatable and deflatable adjacent chambers extending transverse to the pad centerline for treatment of the back of a patient placed thereon in a supine position, comprising:

(A) a lower section comprising a plurality of chambers comprising:

(1) a first elongated chamber including:

(a) first and second spaced outer portions each having a first substantially uniform transverse cross-sectional area for the length thereof, and (b) an intermediate portion having a passage with a second transverse cross-sectional area smaller than the first transverse cross-sectional area of the first and second spaced outer portions, communicating therewith, and forming between the first and second outer portions a void about the intermediate portion;

(2) a second elongated chamber adjacent said lower section first chamber and having a substantially uniform transverse cross-sectional area for the length thereof; and (3) a third elongated chamber adjacent said lower section second chamber and having a substantially uniform transverse cross-sectional area for the length thereof;

(B) an upper section comprising a plurality of chambers including:

(1) first, second, third, and fourth adjacent chambers each having (a) first and second spaced outer portions each having a first substantially uniform transverse cross-sectional area for the length thereof, (b) an intermediate portion having a passage with a second transverse cross-sectional area smaller than the first transverse cross-sectional area of the first and second spaced outer portions, communicating therewith, and forming between the first and second outer portions a void about the intermediate portion;

(2) a fifth elongated chamber having a substantially uniform transverse cross-sectional area for the length thereof.

15. The pad according to claim 14 wherein the lower section first, second and third chambers and the upper section first chamber have about the same length.

16. The pad according to claim 15 wherein the pad upper section second, third, fourth and fifth chambers each has a progressively shorter length.

17. The pad according to claim 15 wherein the pad lower section second and third chambers have approximately the same first transverse cross-sectional area for the length thereof and the lower section first chamber first and second outer portions have a second substantially uniform transverse cross-sectional area smaller than the first transverse cross-sectional area of the lower section second and third chambers.

18. The pad of the claim 14 wherein in a horizontal plane through the longitudinal centerline of the intermediate portion of the lower section first chamber there is a flat area extending adjacent at least a portion of one side of the first chamber intermediate portion.

19. The pad of claim 14 wherein in a horizontal plane through the longitudinal centerline of the intermediate portion of each of the upper section first, second, third, and fourth chambers there is a flat area extending adjacent at least a portion of the length of one side of each first, second, third, and fourth chamber intermediate portion.

20. The pad of claim 19 wherein in a horizontal plane through the longitudinal centerline of the intermediate portion of each of the upper section first, second and third chambers there is a flat area extending adjacent at least a portion of the length of both sides of the intermediate portion of the first, second, and third chambers.

21. Apparatus for treatment of a user's back comprising:

(A) a pad having a longitudinal centerline and formed with a plurality of inflatable deflatable chambers extending transverse to the pad centerline comprising:

(1) a lower section comprising a plurality of adjacent chambers including:

(a) a first elongated chamber having a substantially uniform cross-sectional area for the length thereof, (b) a second elongated chamber adjacent the first elongated chamber and having a substantially uniform cross-sectional area for the length thereof;

(2) an upper section comprising a plurality of adjacent chambers including:

(a) first, second, third, and fourth adjacent chambers each having (i) first and second spaced outer portions each having a first substantially uniform transverse cross-sectional area for a major portion of the length thereof, (ii) an intermediate portion having a passage with a second transverse cross-sectional area smaller than the first cross-sectional area of the first and second spaced outer portions, communicating therewith, and forming between the first and second outer portions a void about the intermediate portion;

(B) a pneumatic system comprising:

(1) air compressor means, (2) pressure regulating means, and (3) a plurality of valve means, each connecting with the compressor means and with one of the pad chambers;

(C) a control system comprising:

(1) user interface means for selecting the parameters of operation for the apparatus;

(2) control means interconnecting with the pneumatic system and with the user interface means to open and close each of the pneumatic system valve means to permit compressed air from the compressor means to sequentially inflate and deflate each of the pad chambers in accordance with the parameters entered into the user interface means;

(3) start/stop means for initiating and stopping operation of the apparatus.

22. The apparatus of claim 21 wherein the pneumatic system pressure regulating means operates at a pressure between 3 and 8 p.s.i.

23. Apparatus for treatment of a user's back comprising (A) a pad having a longitudinal centerline and formed with a plurality of inflatable, deflatable chambers extending transverse to the pad centerline comprising:

(1) a lower section comprising a plurality of adjacent chambers including:

(a) a first elongated chamber having a substantially uniform cross-sectional area for the length thereof, (b) a second elongated chamber adjacent the first elongated chamber and having a substantially uniform cross-sectional area for the length thereof;

(2) an upper section comprising a plurality of adjacent chambers including:

(a) first second, third, and fourth adjacent chambers each having (i) first and second spaced outer portions each having a first substantially uniform transverse cross-sectional area for a major portion of the length thereof, (ii) an intermediate portion having a passage with a second transverse cross-sectional area smaller than the first cross-sectional area of the first and second spaced outer portions, communicating therewith, and forming between the first and second outer portions a void about the intermediate portion;

(B) a pneumatic system comprising:

(1) air compressor means, (2) pressure regulating means, and (3) a plurality of valve means, each connecting with the compressor means and with one of the pad chambers, (C) a control system comprising:

(1) user interface means for selecting the parameters of operation for the apparatus including:

(a) the number of chambers between one and three to be sequentially inflated during a cycle of operation of the pad;

(b) the time period each chamber is to be inflated and then deflated, and (c) the total operating time for the number of cycles of sequential inflation of the pad chambers;

(2) control means interconnecting with the pneumatic system and with the user interface means to open and close each of the pneumatic system valve means to permit compressed air from the compressor means to sequentially inflate and deflate each of the pad chambers in accordance with the parameters entered into the user interface means;

(3) start/stop means for initiating and stopping operation of the apparatus.

24. A method of treating a patient's back having a spinal column, including a sacrum, lumbar, thoracic, and cervical vertebrae portions, and musculature and soft tissue adjacent thereto and across the back adjacent said portions by means of apparatus comprising a pad, a pneumatic system, and a control system, comprising the steps of:

(A) placing on a treatment table a pad having a longitudinal centerline and formed with a plurality of inflatable and deflatable adjacent chambers extending transverse to the pad's centerline comprising:

(1) a lower section comprising a plurality of adjacent chambers including:

(a) a first elongated chamber having a substantially uniform cross-sectional area for about the length thereof;

(b) a second elongated chamber having a substantially uniform cross-sectional area for about the length thereof;

(2) an upper section comprising a plurality of adjacent chambers including:

(a) first, second, and third adjacent chambers each having:

(i) first and second spaced outer portions each having a first substantially uniform transverse cross-sectional area for about the length thereof, and (ii) an intermediate portion having a passage with a second transverse cross-sectional area smaller than the first transverse cross-sectional area of the first and second spaced outer portions, communicating therewith, and forming between the first and second outer portions a void about the intermediate portion;

(B) placing the patient in a supine position with the patient's back in contact with the pad and positioned with:

(1) the patient's spine extending along the pad longitudinal centerline, (2) the lumbar portion of the back above about the lower section first and second elongated chambers, and;

(3) the thoracic portion of the back above about the upper section first, second and third chambers, with the thoracic vertebrae portion of the spine about the intermediate portion of each first, second and third chamber and the first and second outer portions of each chamber spaced rom the thoracic vertebrae portion of the spine;

(C) selecting the desired pressure of inflation for the pad chambers;

(D) selecting in the control system the parameters of operation for the chambers including:

(1) the number of chambers between one and three to be sequentially inflated during a cycle of operation of the pad;

(2) the time period each chamber is to be inflated and then deflated, and (3) the total operating time for the number of cycles of sequential inflation of the pad chambers;

(E) starting operation of the control system and pneumatic system to sequentially:

(1) inflate the pad lower section first chamber to cause expansion thereof, exert upward pressure across the lumbar portion of the back, raise the lumbar portion thereof above the first chamber, and cause deflation thereof;

(2) inflate the pad lower section second chamber to cause expansion thereof, exert upward pressure across the lumbar portion of the back, raise the lumbar portion thereof above the second chamber, and cause deflation thereof;

(3) inflate the pad upper section first chamber to cause expansion of the first and second outer portions thereof, exert upward pressure on the thoracic portion of the back spaced from the thoracic vertebrae of the spine, raise the thoracic portion of the back above the upper section first chamber, and cause deflation thereof;

(4) inflate the pad upper section second chamber to cause expansion of the first and second outer portions thereof, exert upward pressure on the thoracic portion of the back spaced from the thoracic vertebrae of the spine, raise the thoracic portion of the back above the upper section of the second chamber, and cause deflation thereof;

(5) inflate the pad upper section third chamber to cause expansion of the first and second outer portions thereof, exert upward pressure on the thoracic portions of the back spaced from the thoracic vertebrae of the spine, raise the thoracic portion of the back above the upper section third chamber, and cause deflation thereof;

whereby the sequential inflation and deflation of the pad chambers from the pad bottom to top exerts localized upward pressure across the back to mobilize the patient's spine and massage, stretch and relax the musculature and soft tissue of the back above the chambers of the pad.

25. The method of claim 24 wherein the pad lower section first and second chambers expand and raise the lumbar portion of the back thereabove to a greater height above the treatment table than the expansion of the first and second outer portions of the upper section first chamber raise the thoracic portion of the back thereabove.

26. The method of claim 25 wherein the first and second outer portions of each of the upper section second and third chambers expand and raise the thoracic portion of the back thereabove to a height above the treatment table less than the height of expansion of the first and second outer portions of the upper section first chamber raise the thoracic portion of the back thereabove.

* * * * *

UNITED STATES PATENT AND TRADEMARK OFFICE

CERTIFICATE OF CORRECTION

PATENT NO. : 5,211,162

DATED : May 18, 1993

INVENTOR(S) : John F. Gillen, Jr.; Andrew J. Martin

It is certified that error appears in the above-identified patent and that said Letters Patent is hereby corrected as shown below:

Col. 5, line 14, "arc M arc" should read --arc M --are--.

Col. 5, line 37 "heat scaling" should read --heat sealing--.

Col. 9, line 45, "knob 4A" should read --knob --14A--.

Signed and Sealed this

First Day of February, 1994

Bruce Lehman

*Attest:*

BRUCE LEHMAN

*Attesting Officer*

*Commissioner of Patents and Trademarks*